US007673579B2

(12) United States Patent
Smith

(10) Patent No.: US 7,673,579 B2
(45) Date of Patent: Mar. 9, 2010

(54) TRAFFIC FLOW INDICATOR WITH TRAFFIC CONE-MOUNTED MOVABLE POINTER

(76) Inventor: Michael J. Smith, 8 Helaine Ct., Orangeburg, NY (US) 10962

( * ) Notice: Subject to any disclaimer, the term of this patent is extended or adjusted under 35 U.S.C. 154(b) by 0 days.

(21) Appl. No.: 11/039,343

(22) Filed: Jan. 19, 2005

(65) Prior Publication Data

US 2006/0156968 A1 Jul. 20, 2006

(51) Int. Cl.
*E01F 9/012* (2006.01)

(52) U.S. Cl. ..... 116/63 C; 116/63 P; 40/612; D10/114

(58) Field of Classification Search ..... 116/63 P, 116/63 R, 63 C, 28 R, 309, 311, 312, 315, 116/319; 40/590, 591, 593, 606.14, 606.15, 40/612, 611.01, 611.02; 404/6, 9, 10; D10/109, D10/113, 114; D8/367; 24/67 AR; 248/205.4, 248/229.13, 229.16; 211/106.01
See application file for complete search history.

(56) References Cited

U.S. PATENT DOCUMENTS

| | | | | | |
|---|---|---|---|---|---|
| 695,498 | A | * | 3/1902 | Semat | 116/63 R |
| 1,174,360 | A | * | 3/1916 | Shindel | 116/311 |
| 1,238,387 | A | * | 8/1917 | Buck | 116/63 R |
| 1,251,670 | A | * | 1/1918 | Just | 116/319 |
| 1,258,730 | A | * | 3/1918 | Wood | 116/202 |
| 1,497,958 | A | * | 6/1924 | Swinford | 40/612 |
| 1,527,107 | A | * | 2/1925 | Allen | 238/3 |
| 1,901,879 | A | * | 3/1933 | Schiffmann | 40/606.15 |
| D110,646 | S | * | 7/1938 | Petrochko | D10/114 |
| 2,881,543 | A | * | 4/1959 | De Rouen | 116/173 |
| 3,016,224 | A | * | 1/1962 | Hall | 248/205.3 |
| 3,192,889 | A | * | 7/1965 | Crudgington | 116/63 R |
| 3,262,415 | A | * | 7/1966 | Biscardi | 116/63 R |
| 4,176,485 | A | * | 12/1979 | Terris | 40/584 |
| 4,197,808 | A | * | 4/1980 | Kinninger | 116/63 C |
| 4,318,238 | A | * | 3/1982 | Macarle, Jr. | 116/63 P |
| 5,535,971 | A | * | 7/1996 | Adams | 248/215 |
| 5,749,673 | A | * | 5/1998 | Kulp et al. | 404/10 |
| 6,186,699 | B1 | * | 2/2001 | Kulp et al. | 404/10 |
| 6,305,312 | B1 | * | 10/2001 | Bent et al. | 116/63 P |
| 6,386,135 | B1 | * | 5/2002 | Oshima | 116/63 C |
| 6,829,853 | B2 | * | 12/2004 | Kim | 40/607.14 |
| D530,192 | S | * | 10/2006 | Becerra | D8/395 |

FOREIGN PATENT DOCUMENTS

| | | | | |
|---|---|---|---|---|
| CH | 616975 | A | * | 4/1980 |
| FR | 2692294 | A1 | * | 12/1993 |
| GB | 2 182 701 | A | | 5/1987 |
| GB | 2182701 | A | * | 5/1987 |
| GB | 2271594 | A | * | 10/1992 |
| GB | 2263299 | A | * | 7/1993 |
| GB | 2275125 | A | * | 8/1994 |

* cited by examiner

*Primary Examiner*—R. A. Smith
*Assistant Examiner*—Tania C Courson
(74) *Attorney, Agent, or Firm*—Kirschstein, et al.

(57) ABSTRACT

A movable pointer is mounted for pivoting movement on a traffic cone to reliably and safely direct traffic in a desired traffic flow-direction.

7 Claims, 4 Drawing Sheets

TRAFFIC FLOW INDICATOR WITH TRAFFIC CONE-MOUNTED MOVABLE POINTER

BACKGROUND OF THE INVENTION

1. Field of the Invention

The present invention generally relates to traffic control devices and, more particularly, to traffic flow indicators mounted on traffic control devices for directing traffic in a desired traffic flow direction.

2. Description of the Related Art

Traffic control devices such as cones, barrels and tubes are universally used for a variety of traffic control purposes, for example, to warn vehicle drivers, bicycle riders and pedestrians of the presence of road hazards and road construction and maintenance projects, to delineate and separate work zones from lanes of traffic, and to direct the flow of traffic along desired lanes by the staggered placement of the control devices along a roadway. Traffic cones, for example, are deployed either by a machine that can automatically place and retrieve the traffic cones, or manually by a roadway worker riding on the exterior of a modified vehicle. Typically, the worker stands in a basket at the end of a truck, or sits near ground level between the axles of a customized cone body truck. The traffic cones are stacked or nested on the vehicles to conserve storage space.

To carry out their functions properly, the traffic cones must be clearly visible even at night and under adverse weather conditions. To this end, the cones are brightly colored, or provided with reflectors, or equipped with battery-operated lights. Signs and flags can also be mounted on the cones to provide warnings.

Despite the profusion of traffic cones on roadways for the above purposes, one traffic control function that could be improved involves directing traffic along a desired direction. A traffic cone by itself cannot point traffic in a desired traffic flow direction. Instead, a multitude of cones is placed in a staggered manner across a roadway to direct traffic in the desired direction. A typical lane configuration may use eighty cones for each one and a half miles of lane closure. It would, therefore, be desirable to employ fewer cones and to concomitantly lessen the workload of the roadway worker deploying and retrieving the cones. It is, of course, of paramount importance to unmistakably and affirmatively point the traffic in the desired direction.

SUMMARY OF THE INVENTION

Objects of the Invention

Accordingly, it is a general object of this invention to increase traffic safety by pointing traffic in a desired traffic flow direction.

More particularly, it is an object of the present invention to employ fewer traffic control devices than heretofore for directing traffic.

Still another object of the present invention is to provide a traffic flow indicator that can readily be mounted on existing traffic cones.

FEATURES OF THE INVENTION

In keeping with the above objects and others which will become apparent hereinafter, one feature of the present invention resides, briefly stated, in a traffic flow indicator for a traffic control device, such as a traffic cone, barrel, or tube.

The indicator includes a movable pointer, preferably shaped as an arrow, brightly colored and preferably bearing a light reflector. The pointer is mounted on the control device for movement to a pointing position in which the pointer directs traffic in a traffic flow direction. The mounting can be permanent, for example, by an adhesive pad for adhering the indicator to the control device, and/or can be detachable, for example, by using a detachable fastener, typically a clip for insertion into a top opening in the control device.

The pointer is preferably pivotably mounted for turning movement between a stacking position in which the pointer is vertical, and a plurality of pointing positions each of which is angularly spaced from the vertical. For example, the pointing positions can be 90° and 45° spaced clockwise from the vertical, as well as 90° and 45° spaced counterclockwise from the vertical. When the pointer is in one of these angularly spaced pointing positions, a driver, bicyclist or pedestrian is unmistakably advised as to which direction to follow. In the preferred embodiment, a pin is receivable, typically with a snap action, in one of a plurality of angularly spread-apart recesses, one for each position, to maintain the pointer in the desired position.

When a plurality of traffic control devices is nested or stacked together, the pointer, due to its flexibility and thin, planar shape, is accommodated in the space between adjacent stacked control devices. Hence, the indicator need not be, and preferably is not, removed from its control device. During deployment of the control devices, the roadway worker need only push the pointer to the pointing position, typically using a single finger. During retrieval of the control devices, the roadway worker need only nest a next control device over the retrieved control device whose pointer is in the pointing position. The next control device will automatically push the pointer to the vertical stacking position, thereby simplifying storage and retrieval.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 2:
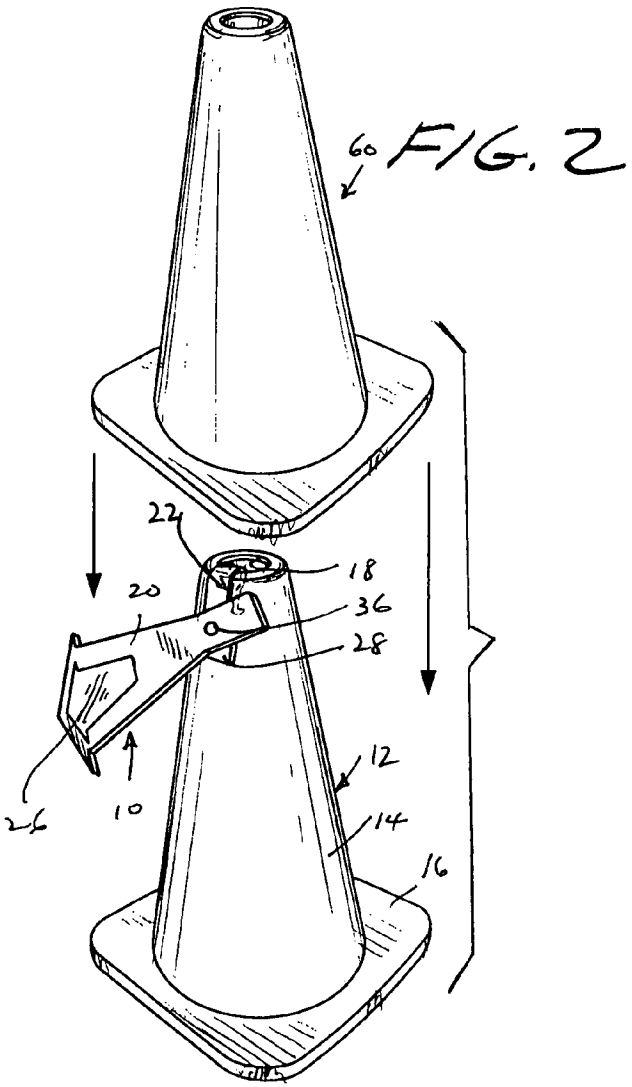
FIG. 2 is a perspective view of the indicator-mounted device of FIG. 1 during nesting with another traffic control device during which the pointer is pushed by the other device to a stacking position according to this invention.
Figure 1:
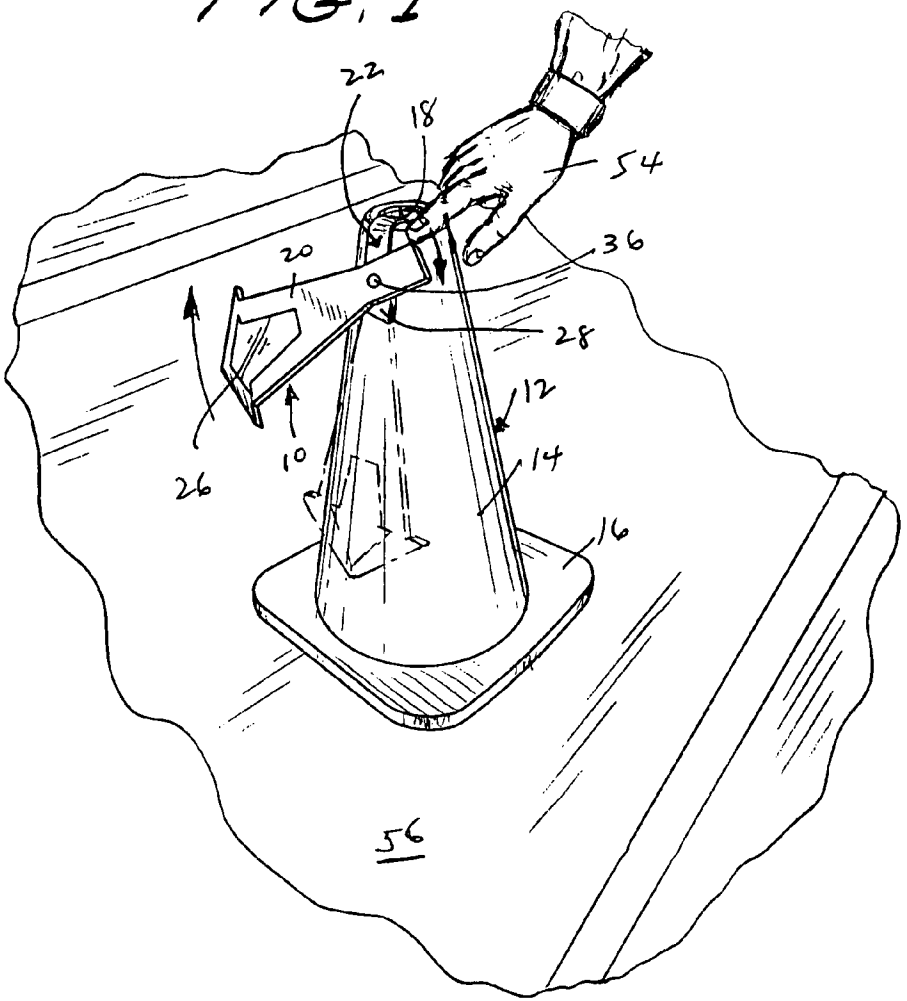
FIG. 1 is a perspective view of a traffic flow indicator mounted on a traffic control device depicting deployment in which a roadway worker pushes a pointer to a pointing position according to this invention.
Figure 3:
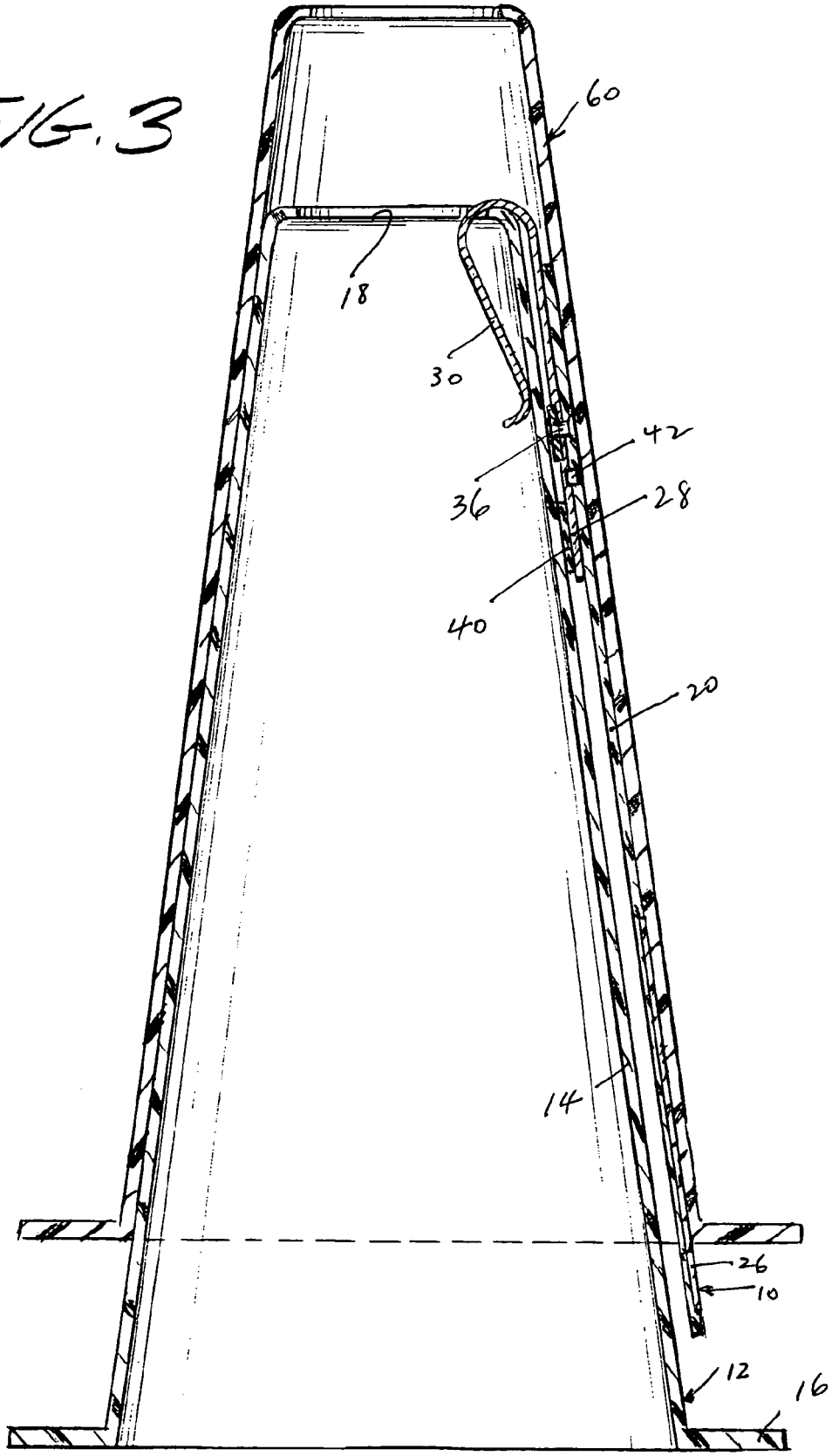
FIG. 3 is an enlarged vertical sectional view after the devices of FIG. 2 have been stacked.

Referring now to the drawings, reference numeral 10 generally identifies a traffic flow indicator shown mounted on a traffic control device 12 in FIGS. 1-3 and in isolation in FIGS.

4-5. Device 12 is depicted as a traffic control cone, but could equally well be other traffic control devices such as barrels or tubes, and may have other shapes such as frusto-pyramidal. The cone 12 has, as is conventional, a hollow frusto-conical body 14 bounding an interior, a generally planar base flange 16 for resting on the ground, and a top opening 18 extending into the interior of the body. The cone is advantageously made of a non-rigid, yieldable material such as plastic or rubber to minimize collision damage to vehicles, is brightly colored in orange or like colors to enhance their visibility, and is often provided with reflectors or reflective tape collars for greater visibility.

Figure 4:
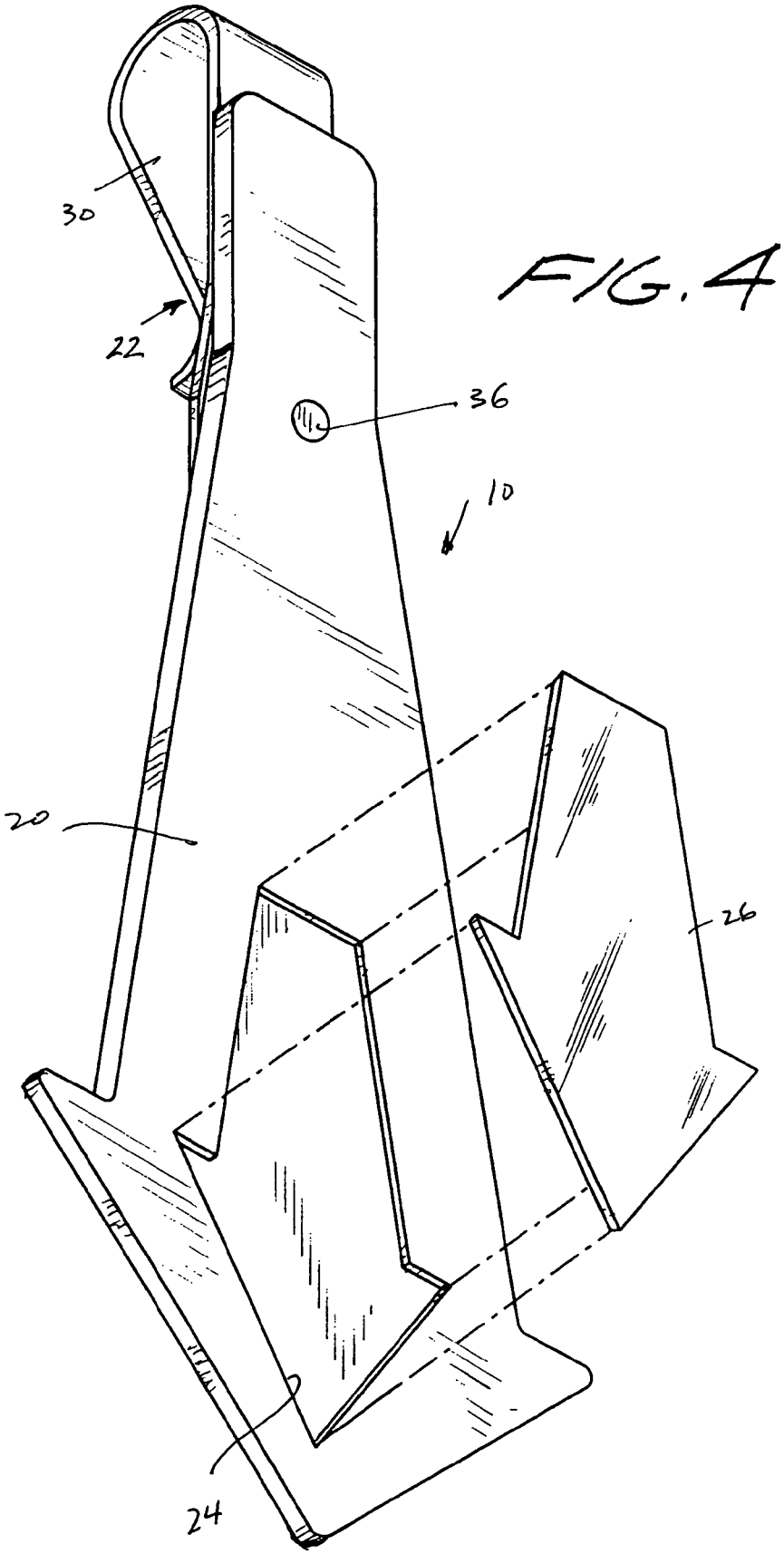
FIG. 4 is a front perspective view of the traffic flow indicator in isolation, with a reflector shown in exploded view.
Figure 5:
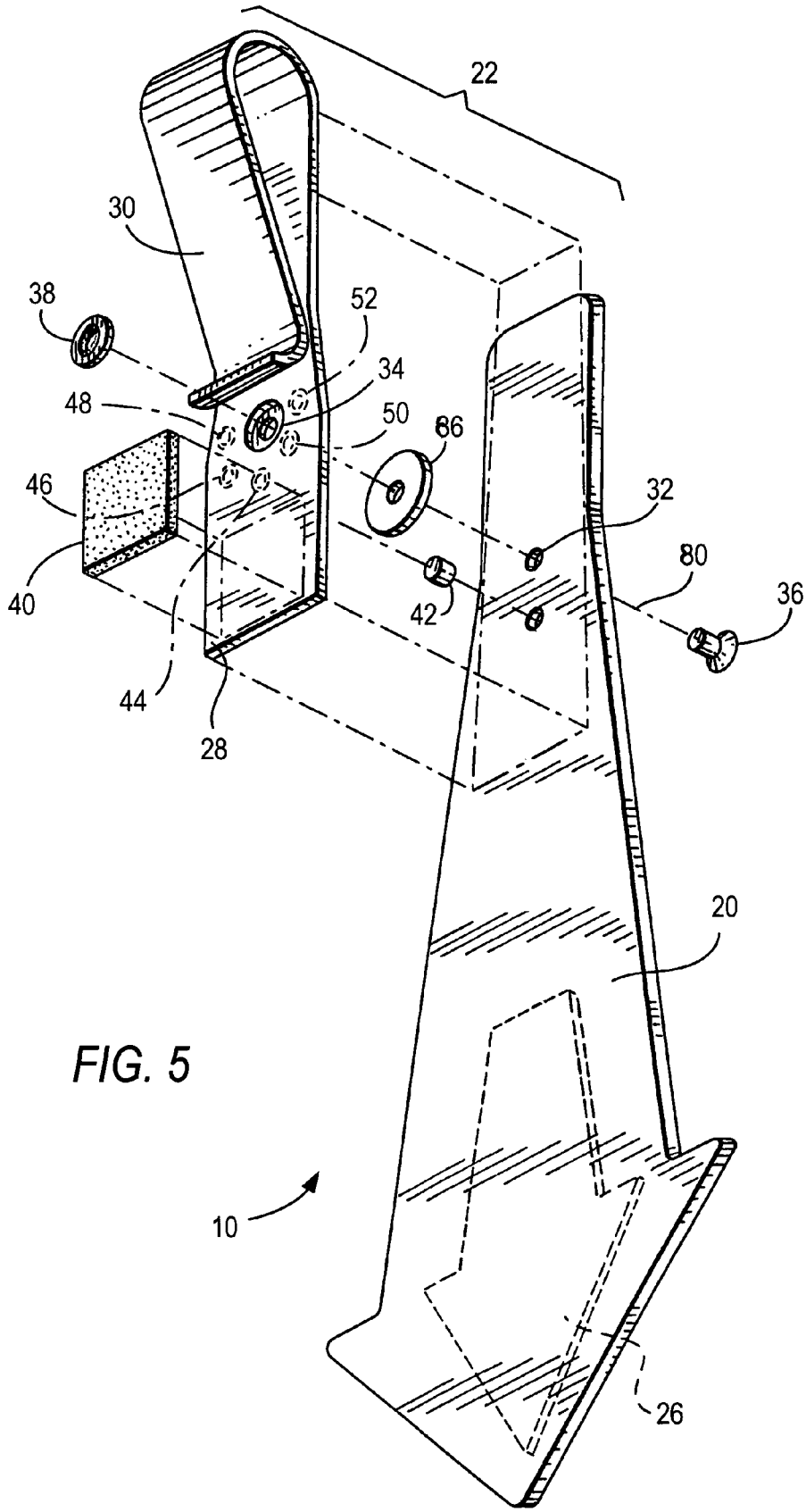
FIG. 5 is a rear perspective, exploded view of the indicator of FIG. 4.

As best seen in FIGS. 4-5, the indicator 10 includes a pointer 20, preferably a thin, planar, arrow-shaped element constituted of a synthetic plastic material, and a mounting assembly 22 for mounting the pointer 20 on the device 12 for movement between a stacking position (shown in phantom lines in FIG. 1) in which the pointer 20 points vertically downward, and any one of a plurality of pointing positions (one of which is shown in solid lines in FIG. 1) in which the pointer 20 is angularly spaced from the vertical in order to direct traffic in a traffic flow direction.

Preferably, the pointer 20 has a shallow, arrow-shaped recess 24 for receiving an arrow-shaped reflector 26 operative for retro-reflecting light incident thereon. The reflector is held in place by a snug friction-fit and/or by an adhesive. The reflector may also be a decal. The pointer may be a solid element as shown, or apertured.

The mounting assembly 22 includes a support plate 28 integral with a spring clip 30 to form a generally U-shaped bracket. A pivot axis 80 is defined by an aperture 32 in the pointer, an aperture 34 in the plate 28, and a pivot pin 36 extending through the apertures 32, 34. An apertured spacer 86 is situated between the plate and the pointer. An apertured lock nut 38 lockingly engages the pin 36 to enable the pointer 20 to be pivoted about the pivot axis 80.

The spring clip 30 is insertable through the top opening 18 of the cone and holds the bracket in place. The clip 30 enables the indicator to be removable from one cone and mounted on another. If this is not preferred, an adhesive pad 40, preferably a double-sided tape, is adhesively mounted on the plate 28 and is also adhered to the body 14 of the cone to prevent removal of the indicator. Other non-detachable mountings can include providing sharp, pointed barbs on the plate, each barb piercing into the body 14.

The pointer 20 is pivotable about the pivot axis 80 to multiple angular positions, which are preferably discrete and repeatable. For example, as shown in FIG. 5, a positioning pin 42 is fixedly mounted in, and projects from, the pointer for joint movement with the pointer 20. The plate 28 is preferably provided with five positioning holes spaced angularly apart. Hole 44 is at the lowest elevation along the vertical; holes 46, 48 are spaced at 45° and 90° respectively away from the vertical in one circumferential direction about the axis 80; and holes 50, 52 are spaced 45° and 90° respectively away from the vertical in an opposite circumferential direction about the axis 80. When the pointer 20 is moved, as described below, the pin 42 is moved into one of these holes, with hole 44 defining the stacking position, and with holes 46, 48, 50, 52 defining various pointing positions for directing traffic.

In use, as shown in FIG. 1, a roadway worker 54 pushes an upper end of the pointer 20 to pivot the same from the vertical stacking position shown in phantom lines. During this turning movement, the pin 42 is forced out of the hole 44 and is moved into juxtaposition with the hole 46, for example, whereupon the pin 42 is received in the hole 46 with a snap-type action. There is sufficient play between the pointer and the bracket to allow movement of the pin in and out of the holes. Once the pin 42 is received in a hole, the pointer is maintained in that position until affirmatively pushed by the worker 54. Wind currents will not move the pointer. Once placed on a roadway surface 56, the pointer unequivocally indicates the desired direction of traffic.

Upon retrieving a deployed cone, it is customary for the worker to nest or stack the cones to conserve space. As shown in FIG. 2, a second cone 60 identical to the first-mentioned cone 12 is stacked thereon. During such stacking, the second cone engages the pointer 20 and automatically pushes it back to the vertical stacking position. FIG. 3 depicts the two stacked cones 60, 12 with the pointer 20 in the stacking position being accommodated in a space between the cones. There is sufficient yieldability in the material of the bodies of the cones to permit receipt of the thin pointer 20.

The pointer 20 need not extend downwardly past the upper cone 60 as shown in FIG. 3, but can be located entirely between the cones. Also, the upper cone 60 has not been depicted with its own indicator 10 for the sake of simplifying the drawings. However, it is preferred that each cone has its own indicator.

It is also contemplated that a battery pack and a set of light emitting diodes (LEDs) be mounted on the indicator so that the light emitted therefrom enhance visibility. A flasher could be included for attracting attention.

It will be understood that each of the elements described above, or two or more together, also may find a useful application in other types of constructions differing from the types described above.

For example, angles other than 45° and 90° could be used. Additional angles could be employed. Rather than providing discrete positions for the pointer, the pointer can be moved to any desired position in a continuous range of pointer positions.

While the invention has been illustrated and described as embodied in a traffic flow indicator with traffic cone-mounted movable pointer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A traffic flow indicator for a traffic cone, comprising:

a) a movable, planar arrow-shaped pointer extending between a pointed end and an opposite shaft end; and b) a bracket mounted on the traffic cone for mounting the pointer on the traffic cone, the pointer being mounted on the bracket for pivoting movement between a stacking position in which the pointer is vertical, the pointer in the stacking position being sized to be accommodated in a space between the traffic cone and another traffic cone nested therewith, and a plurality of pointing positions each of which is angularly spaced from the vertical, the pointer being manually pivotable by pushing on the shaft end, the pointed end of the pointer directing traffic in a traffic flow direction in each pointing position, the pointer in each pointing position being pivotable to the stacking position by the other traffic cone pushing on the pointed end during nesting with the traffic cone.

2. The traffic flow indicator of claim 1, wherein the pointer includes a light reflector.

3. The traffic flow indicator of claim 1, and an adhesive pad adhered to the traffic cone, for adhering the bracket to the traffic cone.

4. The traffic flow indicator of claim 1, wherein the bracket includes a fastener for detachably fastening the indicator to the traffic cone.

5. The traffic flow indicator of claim 4, wherein the fastener is a clip.

6. The traffic flow indicator of claim 1, wherein the bracket includes means for maintaining the pointer in each pointing position.

7. The traffic flow indicator of claim 1, wherein the bracket includes a plurality of recesses, one for each position, and a pin receivable with snap action in a selected one of the recesses.

* * * * *